US005908336A

United States Patent [19]

Schmid et al.

[11] Patent Number: 5,908,336

[45] **Date of Patent: *Jun. 1, 1999**

[54] MULTIPOLE ELECTRICAL PLUG CONNECTOR

[75] Inventors: Roland Schmid, Dettingen; Reinhold Jocham, Hechingen, both of Germany

[73] Assignee: Robert Bosch GmbH, Stuttgart, Germany

[ * ] Notice: This patent is subject to a terminal disclaimer.

[21] Appl. No.: 08/795,621

[22] Filed: Feb. 6, 1997

[30] Foreign Application Priority Data

Feb. 7, 1996 [DE] Germany ..... 296 02 071

[51] Int. Cl.[6] ..... H01R 9/24

[52] U.S. Cl. ..... 439/891

[58] Field of Search ..... 439/885, 891, 439/695; 29/874, 884

[56] References Cited

U.S. PATENT DOCUMENTS

| | | | |
|---|---|---|---|
| 3,086,251 | 4/1963 | Bernat | 439/695 |
| 5,226,840 | 7/1993 | Wojtanek | 439/733.1 |
| 5,340,337 | 8/1994 | Pentz | 439/843 |
| 5,539,978 | 7/1996 | Vanbesien | 29/884 |

FOREIGN PATENT DOCUMENTS

| | | | |
|---|---|---|---|
| 33 10 477 A1 | 1/1984 | Germany . | |
| 2093641 | 1/1982 | United Kingdom | 439/891 |

*Primary Examiner*—Steven L. Stephan
*Assistant Examiner*—Barry M. L. Standig
*Attorney, Agent, or Firm*—Kenyon & Kenyon

[57] ABSTRACT

A multipole electrical plug connector having contact elements narrowly spaced from one another, and the plug connector having small dimensions in a manner favorable in terms of production engineering. To this end, the plug connector has contact elements, each having an attachment section and a contact section, whose attachment sections are manufactured from a one-piece self-supporting punched grid. The thickness d of the punched grid is independent of the thickness a of the contact sections, which are produced separately from the attachment sections and are assembled with them to form the contact elements, which upon integration into a housing of an electrical device are partially equipped with a sheathing made of plastic. The plug connector is preferably used in automotive engineering, for example, in electrical control units with highly integrated circuits.

12 Claims, 1 Drawing Sheet

MULTIPOLE ELECTRICAL PLUG CONNECTOR

FIELD OF THE INVENTION

The present invention relates to a multipole electrical plug connector.

BACKGROUND INFORMATION

A known plug connector of this kind, used, for example, in accordance with German Patent No. DE 33 10 477 A1 in an electrical device, has a plurality of contact elements which, for space reasons, are arranged in multiple rows and each contact element is staggered with respect to the other, transverse to the longitudinal extension of the row.

When the contact sections of the contact elements—which in this case are rectangular in cross section, flat and elongated, and tapered at the free end—are configured as so-called blades, the manufacture of contact elements proceeds from a metal plate whose thickness corresponds to that of the contact sections, since for stability reasons the thickness of the contact sections governs the dimensioning of the contact elements.

The contact elements are formed out of the metal plate by means of a punching operation and optionally a bending operation, constituting a punched grid. They are largely separated from one another by punched gaps which correspond to the later lateral spacings within a row of contact elements. The contact elements are nevertheless still defined in terms of their mutual positions, by means of crosspieces that can later be removed, as a one-piece, easily handled punched grid for a row of contact elements. One punched grid is required for each row of contact elements, and multiple punched grids must be assembled into a contact set for the plug connector.

Only after all the contact elements of the contact set have been partially injection pre-embedded in plastic, the plastic injection pre-embedding having the function of a contact support, are the crosspieces removed and the contact elements electrically separated from one another. These manufacturing steps are cost-intensive and require simplification.

When one or more such plug connectors are introduced into a housing of an electrical device as an integrated connector, by final injection embedding in plastic, and when the functions of the control unit are implemented by means of hybrid circuits or multi-chip modules (MCMs), it may happen, if the electrical device has a large number of functions, that the size of the unit is no longer determined by its circuit elements, but by the number of contact elements. This must be prevented.

SUMMARY OF THE INVENTION

The multipole electrical plug connector according to the present invention has, in contrast, the advantage that the aforementioned inadequacies are satisfactorily eliminated. To this end, attachment sections of the contact elements that lead to connection points of the circuit elements of the electrical device are produced for all contact elements from a one-piece punched grid whose thickness is such that it is self-supporting. As a result, the punched grid is easy to handle for subsequent production processes. The contact sections of the contact elements are delivered separately and joined to the attachment sections. It is thus possible to realize multipole electrical plug connectors that have particularly small dimensions, and that can be economically manufactured.

This is achieved, in particular, by the fact that the punched grid serves only for manufacture of the attachment sections of the contact elements, and the contact sections of the contact elements are joined in their solid thickness, which may differ from that of the punched grid, to the attachment sections as separate parts. With the use of a punched grid for all the contact elements arranged in multiple rows, it is possible to achieve closer spacings between the contact elements than when the contact set is assembled from multiple punched grids.

DETAILED DESCRIPTION OF THE DRAWINGS

DETAILED DESCRIPTION

Figure 1:
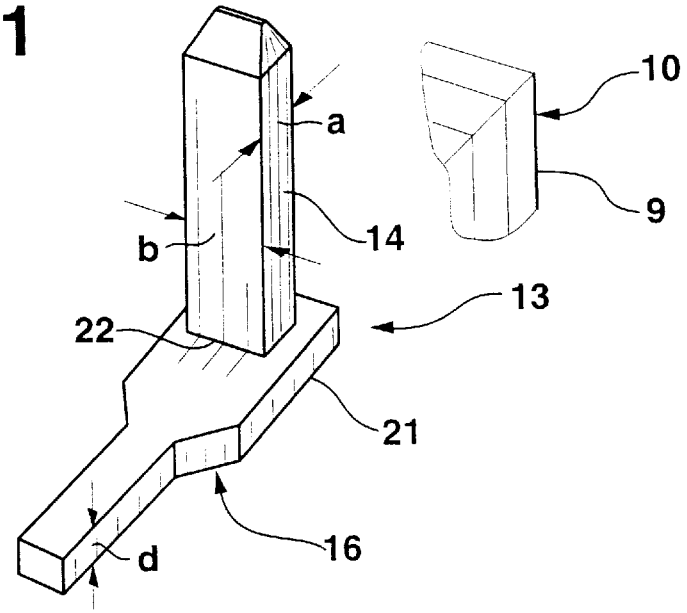
FIG. 1 shows an individual contact element according to the present invention.
Figure 2:
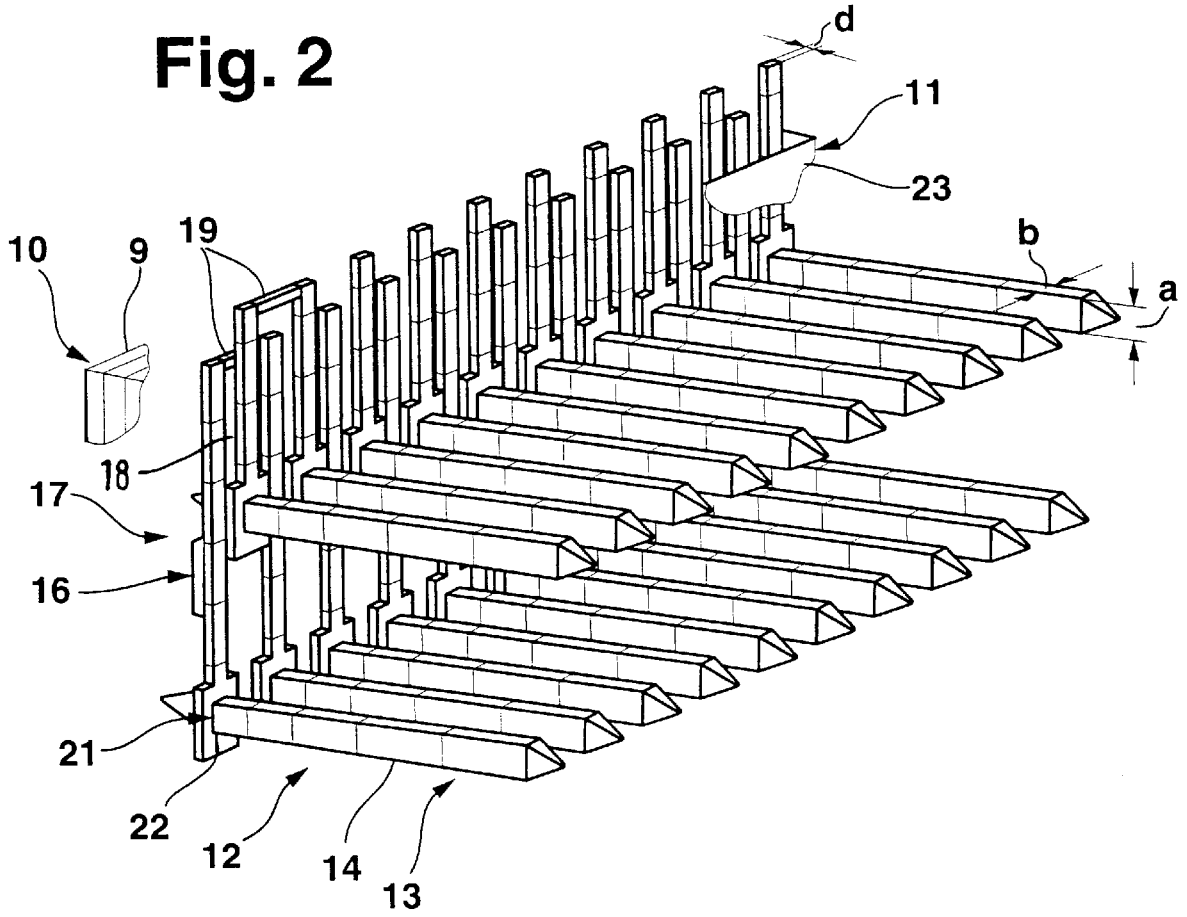
FIG. 2 shows a contact set of a multipole electrical plug connector according to the present invention.

A plug connector 11 depicted in FIGS. 1 and 2 is part of a plug connection integrated into an electrical device 10 and equipped with a mating connector (not depicted) for detachable coupling.

Mounted in plug connector 11 in a manner not described further is a contact set 12 which contains a plurality of contact elements 13 that are arranged in two, or alternatively more, rows parallel to one another. Each of the contact elements 13 has a contact section 14 and an attachment section 16. Contact section 14 consists substantially of an elongated parallelepipedal body. Its rectangular cross-sectional surface has a width b which corresponds approximately to thickness a. Contact section 14 is pointed at its free end in order to facilitate contact with a mating contact element, configured as a spring bushing, of the mating connector.

Contact section 14 can alternatively also be configured as an elongated body with a square or round cross-sectional surface.

Attachment sections 16 of contact elements 13 are web-like tabs with a thickness d that are manufactured from a metal plate of the same thickness by a punching operation, forming a punched grid 17 (FIG. 2). In this punched grid 17, the elongated attachment sections 16 are formed by means of punched gaps 18 which separate them. Attachment sections 16 are, however, still temporarily joined to one another by crosspieces 19, so that, constituting a one-piece unit (punched grid 17), they can be easily handled for further manufacture of plug connector 11.

Attachment sections 16, each of which serves as a bridge between a connection point of a circuit element of a control unit and a contact section 14, have at the end adjacent to the associated contact element a fitting region 21 to receive contact section 14. Present in each of fitting regions 21 is an opening 22, penetrating through attachment section 16, into which the end of associated contact section 14 is pressed. The guidance length corresponding to thickness d of attachment section 16 and of opening 22 thus results in stable preliminary securing of contact section 14 on attachment section 16.

Alternatively, to increase the guidance length, opening 22 can be configured as a dimple by means of a deep-drawing process.

Final securing of contact section 14, standing vertically on fitting region 21, to attachment section 16 takes place by means of direct joining in the region of opening 22, for example by laser welding, soldering, or adhesive bonding.

To complete plug connector 11 and at the same time as integration into a housing 9 of an electrical device 10, punched grid 17 is partially equipped (in a manner depicted in only preliminary fashion) with an electrically insulating injection-embedding material 23 made of plastic, and then divided, by removal of crosspieces 19 of punched grid 17, into individual contact elements 13, electrically insulated from one another and now retained by sheathing 23.

This creates a multipole electrical plug connector 11 whose contact elements 13 can be arranged particularly close to one another, so that even with a plurality of contact elements 13 the plug connector can have small dimensions.

The one-piece punched grid 17 for all contact elements 13 allows plug connector 11 to be produced economically. The advantage of a self-supporting, easily handled punched grid 17, whose thickness is independent of the thickness of contact sections 14, is especially evident when plug connector 11 is equipped with a variety of contact sections 14, for example thin contact sections 14 for signal transmission and wide contact sections 14 for power transmission. Narrow stamped gaps 18 and thus a dense arrangement of attachment sections 16 of contact elements 13 can be achieved with a punched grid 17 configured in this fashion.

When attachment sections 16 formed from punched grid 17 are joined together with contact sections 14, produced separately from strip- or wire-galvanized material, into contact elements 13, considerably smaller spacings between contact elements 13 can be achieved as compared to multiple-row, conventionally configured plug connectors 11 in which contact sections 14 are obtained directly from punched grid 17 together with attachment sections 16, since the developed dimensions of contact sections 14 on punched grid 17 no longer govern the spacings of contact elements 14 from one another.

In particular, the dense arrangement of attachment sections 16 also allows a closely spaced connection pattern for making contact with the circuit elements.

What is claimed is:

1. A multipole electrical plug connector that is mounted in a housing of an electrical device and is provided with a mating connector for detachable coupling, comprising:

a contact set including a plurality of contact elements, each of the contact elements having an attachment section and a contact section, each contact section being coupled to a corresponding attachment section, each attachment section being constructed from a self-supporting, one-piece punched grid.

2. The plug connector according to claim 1, wherein each attachment section includes, in a fitting region, an opening to receive the corresponding contact section.

3. The plug connector according to claim 2, wherein each contact section is coupled to the corresponding attachment section using a partial press fit of the contact section into the opening of the corresponding attachment section.

4. The plug connector according to claim 3, wherein each contact section is coupled to the corresponding attachment section in the fitting region by at least one of welding, soldering, and adhesive bonding.

5. The plug connector according to claim 4, wherein a first contact section has a different cross-sectional surface than a second contact section.

6. The plug connector according to claim 4, wherein each contact section is configured as a plug pin, and produced from at least one of a strip-tinned material and a wire-tinned material.

7. The plug connector according to claim 6, wherein after coupling each contact section to the corresponding attachment section, the punched grid is integrated into a housing of an electrical device, and is at least partially provided with an electrically insulating sheathing.

8. The plug connector according to claim 7, wherein the electrically insulating sheathing is made of plastic.

9. The plug connector according to claim 1, wherein each attachment section is a tab element arranged according to a web configuration, each tab element being formed from the self-supporting, one-piece punched grid.

10. The plug connector according to claim 1, further comprising at least one cross-piece for joining adjacent attachment sections.

11. The plug connector according to claim 10, wherein the adjacent attachment sections are joined by the at least one cross-piece for a predetermined duration.

12. The plug connector according to claim 1, wherein each pair of adjacent attachment sections are separated from each other by a corresponding punched gap.

* * * * *